US006303257B1

(12) United States Patent
Hasegawa et al.

(10) Patent No.: US 6,303,257 B1
(45) Date of Patent: Oct. 16, 2001

(54) ELECTROPHOTOGRAPHIC TONER AND IMAGE FORMING METHOD USING THE TONER

(75) Inventors: Kumi Hasegawa; Yasuaki Iwamoto; Masahide Yamashita, all of Numazu (JP)

(73) Assignee: Ricoh Company Limited, Tokyo (JP)

( * ) Notice: Subject to any disclaimer, the term of this patent is extended or adjusted under 35 U.S.C. 154(b) by 0 days.

(21) Appl. No.: 09/579,138

(22) Filed: May 30, 2000

(30) Foreign Application Priority Data

May 28, 1999 (JP) ..... 11-149674

(51) Int. Cl.[7] ..... G03G 9/087

(52) U.S. Cl. ..... 430/109.3; 430/109.4; 430/111.4; 430/97

(58) Field of Search ..... 430/109, 97, 109.4, 430/109.3, 106.1, 111.4

(56) References Cited

U.S. PATENT DOCUMENTS

| | | | | |
|---|---|---|---|---|
| 4,980,258 | | 12/1990 | Aoki et al. . | |
| 5,225,303 | | 7/1993 | Tomita et al. . | |
| 5,716,746 | * | 2/1998 | Mikuriya et al. | 430/109 |
| 5,736,288 | * | 4/1998 | Kasuya et al. | 430/109 |
| 5,753,399 | * | 5/1998 | Hayase et al. | 430/109 |
| 5,840,456 | | 11/1998 | Tomita et al. . | |
| 5,882,832 | | 3/1999 | Tosaka et al. . | |
| 5,972,553 | * | 10/1999 | Katada et al. | 430/109 |

FOREIGN PATENT DOCUMENTS

| | | |
|---|---|---|
| 49-101031 | 9/1974 | (JP) . |
| 57-174866 | 10/1982 | (JP) . |
| 57-179866 | 11/1982 | (JP) . |
| 60-032060 | 2/1985 | (JP) . |
| 60-136752 | 7/1985 | (JP) . |
| 60-186854 | 9/1985 | (JP) . |
| 60-186859 | 9/1985 | (JP) . |
| 60-186864 | 9/1985 | (JP) . |
| 60-186866 | 9/1985 | (JP) . |
| 02-167561 | 6/1990 | (JP) . |
| 09-096923 | 4/1997 | (JP) . |
| 09-080814 | 9/1997 | (JP) . |

* cited by examiner

*Primary Examiner*—Christopher Rodee
(74) *Attorney, Agent, or Firm*—Oblon, Spivak, McClelland, Maier & Neustadt, P.C.

(57) ABSTRACT

An electrophotographic toner comprising a binder resin, colorant, and an external additive, wherein the binder resin is soluble in tetrahydrofuran and includes at least a first resin component and a second resin component, wherein the first resin component has a molecular weight distribution such that a peak is present in a molecular weight range of from 1,000 to 10,000, and the second resin component has a molecular weight distribution such that a peak is present in a molecular weight range of from 100,000 to 10,000,000, wherein the peak of the first resin component is the largest, and the second resin component is present in the binder resin in an amount of from 10 to 30% by weight, and wherein the second resin component has a dynamic modulus G' of from 100,000 to 50,000,000 dyne/cm$^2$ when the dynamic modulus is measured by a frequency sweep method under conditions of 150° C. in temperature and 0.01 to 100 rad/sec in frequency.

8 Claims, 1 Drawing Sheet

ELECTROPHOTOGRAPHIC TONER AND IMAGE FORMING METHOD USING THE TONER

BACKGROUND OF THE INVENTION

1. Field of the Invention

The present invention relates to an electrophotographic toner for developing an electrostatic latent image formed by electrophotography and the like, and to an electrophotographic image forming method using the toner.

2. Discussion of the Background

Electrophotographic image forming methods typically include the following processes:

(1) the surface of an image bearing member (a photoreceptor) is charged (charging process);
(2) the image bearing member (photoreceptor) is exposed to light to form an electrostatic latent image thereon (latent image forming process);
(3) the latent image is developed with an electrophotographic toner to form a toner image on the image bearing member (developing process);
(4) the toner image is transferred onto a receiving material (transferring process); and
(5) the toner image on the receiving material is fixed upon application of heat, pressure, solvent vapor, or combination thereof to prepare a copy image (fixing process).

The methods for developing electrostatic latent images are broadly classified into the following methods:

(1) wet developing methods using a liquid developer including a fine color pigment or dye dispersed in a liquid: and
(2) dry developing methods such as cascade methods, magnetic brush methods and powder cloud methods, which use a toner including a colorant such as carbon black dispersed in a binder resin.

Recently the dry developing methods are widely used.

The dry developers are broadly classified into one-component developers including a magnetic toner, and two-component developers including a toner and a magnetic carrier which imparts a frictional charge to the toner. Two-component developers are suitable for forming multiple color images because of having good color reproducibility.

The properties requisite for the dry toners are as follows:

(1) good charge properties;
(2) good thermal properties such as good resistance to blocking;
(3) good mechanical strength;
(4) good chemical properties such as resistance to chemicals and good fluidity;
(5) good powder properties;
(6) a property so as not to contaminate or damage a developing device, a photoreceptor and other elements in an image forming apparatus;
(7) good stability so as not to deteriorate even when used for a long time; and
(8) good cleaning property.

With respect to the fluidity, a toner preferably has good fluidity so as to be easily fed and charged in a developing device. Therefore, a technique in which a fine particulate inorganic material having an average particle diameter of from about 5 nm to about 100 nm is added to a mother toner is disclosed. In addition, a technique in which a fine particulate inorganic material having an average particle diameter of from about 0.5 $\mu$m to about 5 $\mu$m is added to a mother toner to impart good cleaning property to the resultant toner has been disclosed in Japanese Laid-Open Patent Publications Nos. 57-174866, 60-136752 and 60-32060. Further, a technique in which a fine particulate organic material having an average particle diameter of from about 0.05 $\mu$m to about 5 $\mu$m is added to a mother toner has been disclosed in Japanese Laid-Open Patent Publications Nos. 60-186854, 60-186859, 60-186864 and 60-186866.

In such toners including a fine particulate inorganic or organic material as an external additive, a problem such that the external additive is released from the toner surface or embedded into the toner tends to occur.

When the external additive is released from or embedded into the toner, the toner loses good fluidity and good charge properties which are imparted to the toner by the external additive. Therefore, the toner causes many problems such as deterioration of image qualities.

In particular, the external additive released from a toner tends to damage the surface of a photoreceptor, resulting in formation of a black streak image.

In attempting to solve these problems, a technique such that an inorganic metal oxide having a relatively large particle diameter of from 150 nm to 5 $\mu$m is added to a toner is disclosed in Japanese Patent Publication No. 2-45188. However, the technique has a drawback in that such a metal oxide has poor adhesion to the toner, and when the toner is used for a long time, the metal oxide is released from the toner. In addition, a technique such that a silica is adhered to a toner is disclosed in Japanese Laid-Open Patent Publication No. 2-167561. However, the technique has a drawback in that the additive is rather easily embedded into the toner.

In attempting to prevent an external additive from being released from a toner, Japanese Laid-Open Patent Publication No. 9-96923 discloses a technique in which two kinds of fine particulate hydrophobic metals and a toner are mixed to prepare a toner on the surface of which the fine particulate hydrophobic metal is uniformly adhered. In order to prevent the external additives from being released from the toner, the toner and the additives have to be mixed upon application of strong force in a mixer, and thereby the additive is embedded in the toner. Therefore, the technique does not produce good effects.

In addition, in attempting to prevent an external additive from being released from or embedded into a toner, Japanese Laid-Open Patent Publication No. 5-119515 discloses a toner which is prepared by adding a plate-shaped fine particulate material to a mother toner. However, the toner has a drawback in that when the toner is used for a long time, the plate-shaped fine particulate material tends to release from the toner.

Toner preferably has a good fixing property. When a toner is used in an image forming apparatus having a fixing device including a heat roller, a toner image contacts the heat roller upon application of pressure while the toner of the toner image is melted. Therefore, an offset problem in that a part or an entire part of the toner image tends to be offset to the heat roller. The offset image is then transferred to the receiving material or the following receiving material, resulting in formation of background fouling.

In attempting to solve the offset problem, Japanese Patent Publication No. 51-23354 discloses a toner using a crosslinked polymer as a binder resin, and Japanese Laid-Open Patent Publication No. 49-6523 discloses a toner including a low-molecular-weight polyolefin such as polypropylene and polyethylene. In addition, in attempting to improve the fixing property and the offset problem, Japanese Laid-Open Patent Publication No. 9-80814 discloses a toner which uses two kinds of binder resins having different molecular weights and glass transition temperatures, wherein the differences of the binder resins in molecular weight and glass transition temperature are specified.

However, these toners cannot exhibit a combination of good resistance to offset phenomenon, good resistance to abrasion, and good fixing property.

In addition, in attempting to prepare a toner having good low temperature fixability and resistance to offset phenomenon, a technique in which a polyester resin including a novolak type phenolic resin as a constitution unit is used as a binder resin. However, the toner does not exhibit a combination of good resistance to offset phenomenon and good low temperature fixing property. In addition, the olefin tends to be released from the toner and then adhered to a carrier, resulting in contamination of the carrier. Therefore, the charging properties of the toner deteriorate, resulting in formation of background fouling in the developed toner images. Further, the toner including an olefin has poor fluidity and thereby the toner tends to be unevenly fed to a developing area, resulting in formation of images having uneven image density.

In the developing method using a heat roller, the surface of the heat roller is typically formed with a releasing material such as fluorine-containing resins. In addition, an offset preventing liquid such as silicone oils is typically applied on the surface of the heat roller to cover the surface of the heat roller with the liquid. When the liquid is heated by the heat for fixing, the liquid generates a nasty odor. In addition, a mechanism for supplying the liquid is needed, and thereby the image forming apparatus becomes complex and the manufacturing costs of the apparatus increase.

In addition, in a developing device using a magnetic toner, a problem in that images fixed in low temperature conditions have poor fixing property tends to occur because the toner includes magnetic particles therein, which do not melt by the heat for fixing.

Further, magnetic particles included in a magnetic toner are typically hard, and are present in toner particles while the magnetic particles project their top from the surface of the toner. Therefore, when the magnetic toner is used for a developing method using a magnetic brush, the image bearing member tends to be damaged, in particular, under low temperature conditions, and thereby the image qualities of the produced images deteriorate.

In a latest high speed copier using a heat roller to which relatively low heat energy is supplied (i.e. in an energy-saved high speed copier), it is difficult to prevent the offset problem. Namely, in order to avoid the offset problem, the binder resin in the toner preferably has good toughness and good melt fluidity However, in order to impart the good melt fluidity to the toner, the toner must be heated to a relatively high temperature. Therefore, the toner does not meet the requirement of low temperature fixing. When a resin having a relatively low glass transition temperature and a low molecular weight is used in a toner as a binder resin to improve the low temperature fixing property, the resultant toner has poor toughness, resulting in occurrence of the offset problem.

In order to prepare a toner having toughness so as to avoid the offset problem, a polymer having an average molecular weight of not less than 100,000 is typically used. In particular, vinyl polymers are typically used for this purpose. In order to fix a toner including a high molecular weight vinyl polymer at a low temperature, the glass transition temperature of the vinyl polymer is minimized as far as the resultant toner does not cause the blocking problem. Alternatively, a method in which a plasticizer is added to a toner to improve the low temperature fixing property. However, these methods decease not only the minimum fixing temperature (i.e., the temperature below which toner images cannot be perfectly fixed), but also the offset temperature (the temperature above which the offset phenomenon occurs). Therefore, the methods only move the fixing temperature range between the minimum fixing temperature and the offset temperature (this range is also called as fusing latitude) toward a low temperature side. If the weight average molecular weight of the binder resin is increased to prevent the decrease of the offset temperature, the toner loses the low temperature fixing property obtained by decreasing the glass transition temperature or adding the plasticizer. In addition, when the weight average molecular weight of the binder resin is increased, the toner is not easily pulverized, resulting in deterioration of productivity of the toner.

Polyester reins having both a relatively low glass transition temperature and a low molecular weight can be easily manufactured. This is the difference between polyester resins and vinyl polymers. Therefore, a toner having low temperature fixability can be easily prepared by using a polyester resin as a binder resin. However, such a toner seriously causes the offset problem, and therefore cannot be used for a developing device using a heat roller.

In attempting to prepare a toner having both an advantage of polyester resins of imparting low temperature fixability and an advantage of vinyl polymers such that that the offset problem tends not occur at a relatively high temperature, a toner including a polyester resin and a vinyl polymer is disclosed in Japanese Laid-Open Patent Publication No. 54-114245. However, the compatibility of a polyester resin and a vinyl polymer is not good. In particular, the more the difference in molecular weight between a polyester resin and a vinyl polymer, the worse the compatibility thereof. When the mixture of these resins is observed with a microscope, one of the resin is present like an island in a sea of the other resin. This island-sea phenomenon can be observed when plastics having poor compatibility are blended. This island-sea phenomenon is described in detail in Plastics 13, No. 9 pp 1 (1962).

When the binder resin components of a toner achieve such an island-sea state, the other components of the toner such as a colorant and a polarity controlling agent cannot be uniformly dispersed in the toner. Therefore, when the toner is repeatedly used toner particles having an opposite charge are formed resulting in formation of background fouling in the resultant toner images.

In addition, a method is provided in which a graft polymer in which a polyester resin and a vinyl resin is grafted using a common segment is used as a binder resin. However, the resultant toner does not have a combination of the advantages of the polyester resin and the vinyl resin, but has the average property of the polyester resin and the vinyl resin.

Because of these reasons, a need exists for an electrophotographic toner having good charge properties, and producing good images without causing undesired images such as black streak images and background fouling even when repeatedly used for a long time.

SUMMARY OF THE INVENTION

Accordingly, an object of the present invention is to provide an electrophotographic toner capable of maintaining good charge properties, and producing good images without causing undesired images such as black streak images and background fouling even when repeatedly used for a long time.

Another object of the present invention is to provide an electrophotographic toner which can be fixed at a relatively low temperature in a heat roll fixing method and which has good offset resistance.

Yet another object of the invention is to provide an electrophotographic toner having good productivity in pulverization type toner manufacturing methods.

A further object of the present invention is to provide an electrophotographic image forming method in which good images are produced without causing undesired images such as black streak images and background fouling even when repeatedly used for a long time.

Briefly these objects and other objects of the present invention as hereinafter will become more readily apparent can be attained by an electrophotographic toner including a binder resin, a colorant, and an external additive, wherein the binder resin is soluble in tetrahydrofuran and includes at least a first resin component and a second resin component, wherein the first binder resin has a molecular weight distribution measured by a GPC method such that a peak is present in a molecular weight range of from 1,000 to 10,000, and the second resin component has a molecular weight distribution such that a peak is present in a molecular weight range of from 100,000 to 10,000,000, wherein the peak of the first resin component is the largest, and the second resin component is present in the binder resin in an amount of from 10 to 30% by weight, and wherein the second component has a dynamic modulus G' of from 100,000 to 50,000,000 dyne/cm$^2$ when the dynamic modulus is measured by a frequency sweep method under conditions of 150° C. in temperature and 0.01 to 100 rad/sec in frequency.

Preferably the binder resin does not include a component having a molecular weight less than 1,000. In addition, the toner preferably has an MI (melt index) of from 5 to 30 g/10 minutes.

The binder resin preferably includes one or more polyester resins of from 50 to 80% by weight and one or more styrene-acrylic resins of from 20 to 50% by weight.

An electrophotographic image forming method including the steps of forming an electrostatic latent image on an image bearing member, and developing the latent image with a developer including a toner to form a toner image on the image bearing member, wherein the toner is the toner mentioned above.

These and other objects, features and advantages of the present invention will become apparent upon consideration of the following description of the preferred embodiments of the present invention taken in conjunction with the accompanying drawing.

BRIEF DESCRIPTION OF THE DRAWING

Various other objects, features and attendant advantages of the present invention will be more fully appreciated as the same becomes better understood from the detailed description when considered in connection with the accompanying drawing in which like reference characters designate like corresponding parts throughout and wherein.

DETAILED DESCRIPTION OF THE INVENTION

Figure 1:
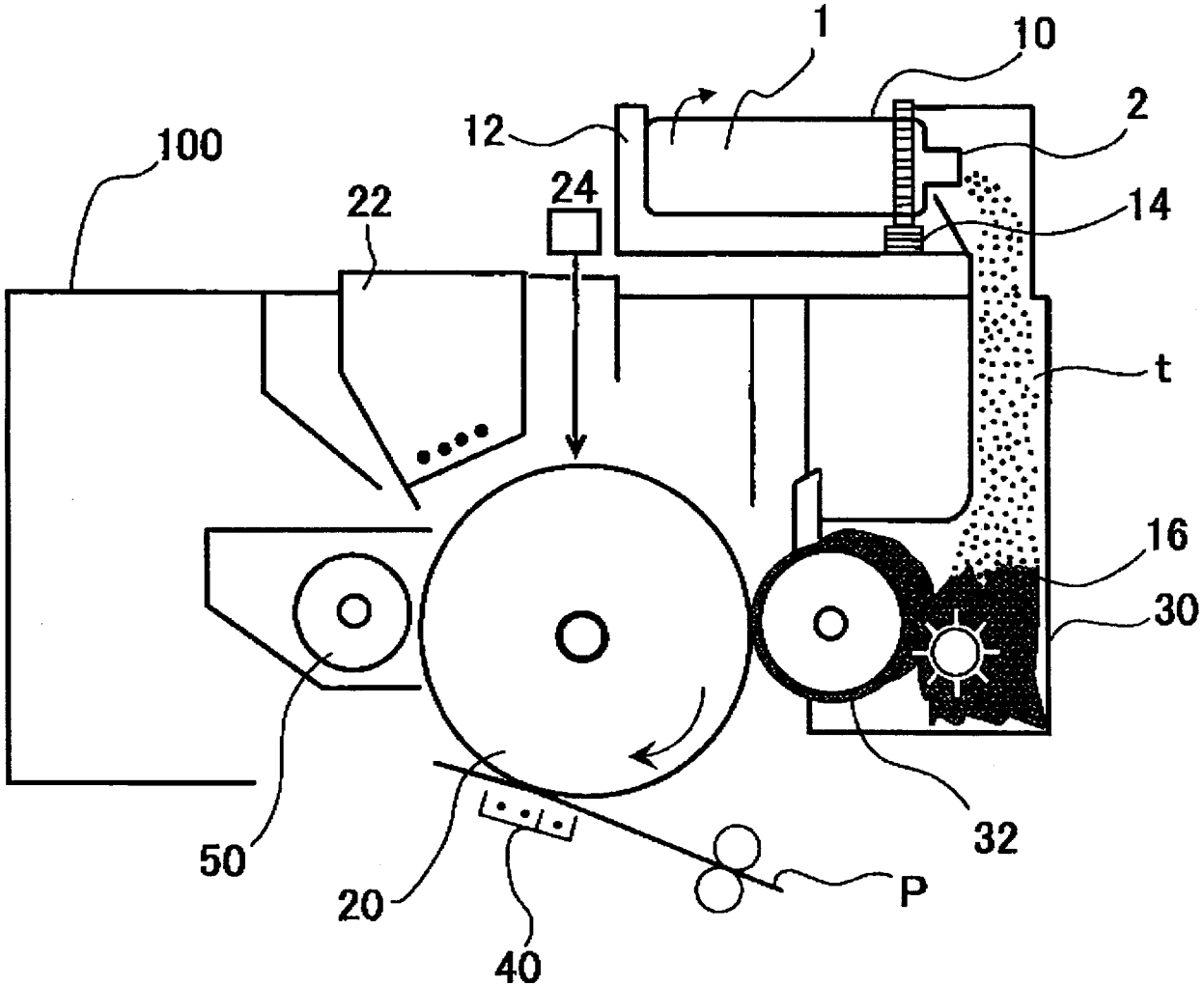
FIG. 1 is a schematic view illustrating an electrophotographic image forming apparatus useful for the image forming method of the present invention.

When the thermal properties and fusion viscoelasticity properties of a toner are evaluated, flow starting temperature and melt index (MI) are conventionally measured using a flow tester. However, by this method, the apparent viscosity of the toner can only be measured. Toner typically exhibits both viscosity and elasticity, i.e., toner is a viscoelastic material. The present inventors discover that to quantitatively analyze the viscoelasticity properties of a toner is important for solving the problem such that the external additive is released from or embedded into the toner and for improving fixing properties of the toner.

When a toner on which an external additive is present is manufactured, it is needed that the external additive is forcibly adhered to the mother toner particles by applying a mechanical force to the toner in a mixer to prevent the additive being released from the toner. At this point, when the surface of the toner has a weak mechanical strength (i.e., the surface is soft), a problem occurs such that the additive is embedded into the toner or the toner particles aggregate each other. Therefore, the mother toner particles have to be hard enough to endure the mechanical force in the mixer.

Fixing properties are another important property requisite for the toner. In order to prepare a toner having good fixing properties, the toner has to have proper flexibility.

The present inventors have researched how to prepare a toner having a combination of the hardness and the good fixing property and good hot-offset resistance. As a result, the present inventors discover the following.

Namely, the above-mentioned object can be attained by a toner an electrophotographic toner including a binder resin, a colorants and an external additive, wherein the binder resin is soluble in tetrahydrofuran and includes at least a first resin component (a main-peak resin component) and a second resin component (a sub-peak resin component), wherein the first binder resin component has a molecular weight distribution measured by a GPC method such that a peak is present in a molecular weight range of from 1,000 to 10,000, and the second resin component has a molecular weight distribution such that a peak is present in a molecular weight range of from 100,000 to 10,000,000, wherein the peak of the first resin component is largest and the second resin component is present in the binder resin in an amount of from 10 to 30% by weight, and wherein the second resin component has a dynamic modulus G' of from 100,000 to 50,000,000 dyne/cm$^2$ when the dynamic modulus is measured by a frequency sweep method under conditions of 150° C. in temperature and 0.01 to 100 rad/sec in frequency.

The dynamic modulus G' concerns the cohesive force of the toner. When the dynamic modulus G' of a toner increases, the hardness of the toner increases and thereby the toner can endure the mechanical force applied thereto when an external additive is added to the toner.

The toner of the present invention includes a binder resin having a molecular weight distribution of from about 1,000 to about 10,000,000. One or more resin components of the binder resin having a molecular weight less than 100,000 mainly exhibit viscous behavior. The resin components influence the hardness of the toner only to a small extent. One or more components of the binder resin having a molecular weight of from 100,000 to 10,000,000 mainly influence the hardness (i.e., dynamic modulus) of the toner. The resin components having a molecular weight of from 100,000 to 10,000,000 have a dynamic modulus G' of from 100,000 to 50,000,000 dyne/cm$^2$ when the dynamic modulus is measured by a frequency sweep method under conditions of 150° C. in temperature and 0.01 to 100 rad/sec in frequency. The components having a molecular weight of from 100,000 to 10,000,000 largely influence the hardness of the toner.

When the dynamic modulus G' is too large, the fixing property of the resultant toner deteriorates because the toner does not melt in a fixing process. On the contrary, the dynamic modulus G' is too small, the hardness of the toner deteriorates, and therefore the external additive tends to be embedded into the toner particles.

In addition, the binder resin does not include a component which is insoluble in tetrahydrofuran. When a component insoluble in tetrahydrofuran is included, the fixability of the resultant toner deteriorates. Further, the binder resin has a molecular weight distribution such that a main peak is present in a range of from 1,000 to 10,000 and a sub peak in a range of from 100,000 to 10,000,000. The one or more components which exhibit the sub peak are present in the binder resin in an amount of from 10 to 30% by weight in the binder resin.

By preparing a toner including a binder resin having a molecular weight distribution such that a main peak is present in a range of from 1,000 to 10,000, the toner has a combination of good offset resistance and good fixability. In addition, the pulverizability of the toner in pulverization type toner manufacturing methods is improved. By preparing a toner including a binder resin in which components having a molecular weight distribution such that a peak is present in a range of from 1,000 to 10,000 are present in the binder resin in an amount of from 10 to 30% by weight, the hot-offset resistance of the toner can be improved without deteriorating the fixability. In addition, the materials included in the toner can be uniformly dispersed because a proper shearing force can be applied when kneading the toner materials.

When the concentration of the sub-peak resin components is too low (i.e., less than 10 the hot-offset resistance deteriorates. On the contrary, when the concentration of the sub-peak resin components is too high, the fixability deteriorates. In addition, the efficiency in the kneading process deteriorates, resulting in deterioration of productivity because the melt viscosity of the toner materials is too high.

In addition, it is preferable that the binder resin does not include a resin component having a molecular weight less than 1,000 to maintain good pulverizability in pulverization type toner manufacturing methods. When a resin component having a molecular weight less than 1,000 is present, the component tends to adhere to the pipes and/or collision plate of the pulverizer, resulting in deterioration of productivity of the toner. Further, the toner which does not include a resin component having a molecular weight less than 1,000 has good preservation property.

In addition, in order to improve the fixing property, the toner preferably has a melt index (MI) of from 5 to 30 g/10 minutes, preferably from 10 to 25 g/10 minutes, and even more preferably from 15 to 20 g/10 minutes. When the melt index is too small, the fixing property deteriorates. On the contrary, when the melt index is too large, the hot-offset resistance deteriorates.

In the present invention, known resins can be used. However, polyester resins are preferably used for preparing a toner having a wide fixing temperature range. When one or more polyester resins are only used as a binder resin, the charge properties of the resultant toner tend to change depending on environmental conditions (i.e., the toner has unsatisfactory environmental stability). Therefore, it is preferable that one or more styrene-acrylic resins and one or more polyester resins are included in the toner in an amount of from 20 to 50% by weight, and from 50 to 80% by weight, respectively.

Specific examples of the resins for use as the binder resin include homopolymers of styrene or substitution products of styrene such as polystyrene, poly-p-chlorostyrene, and polyvinyl toluene; and styrene copolymers such as styrene-p-chlorostyrene copolymers, styrene-propylene copolymers, styrene-vinyl toluene copolymers, styrene-vinyl naphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl a-chloromethacrylate copolymers, styrene-acrylonitrile copolymers, styrene-vinyl methyl ketone copolymers, styrene-butadiene copolymers, styrene-isoprene copolymers, and styrene-maleic acid copolymers; homopolymers or copolymers of (meth)acrylates such as polymethyl acrylate, polybutyl acrylate, polyethyl methacrylate, and polybutyl methacrylate; vinyl polymers and their derivatives such as polyvinyl chloride, and polyvinyl acetate; polyester type polymers, polyurethane type polymers, polyamide type polymers, polyimide type polymers, polyol type polymers, epoxy type polymers, terpene type polymers, aliphatic or alicyclic hydrocarbon resins, aromatic petroleum resins, and the like resins. These resins are used alone or in combination. The binder resin is not limited thereto.

Among these resins, one or more resins of styrene-acrylic polymers, polyester resins, and polyol resins are preferably used as a binder resin in the viewpoint of binding property, charge property and manufacturing costs.

Suitable colorants for use in the toner include known pigments and dyes which have been used for the conventional toners. Specific examples of the pigments and dyes include carbon black, lamp black, iron black, ultramarine blue, Nigrosine dyes, Aniline Blue, Phthalocyanine Blue, Phthalocyanine Green, Hansa Yellow G, Rhodamine 6C Lake, Chalco oil blue, Chrome Yellow, Quinacridone Red, Benzidine Yellow, Rose Bengale, triarylmethane type dyes and the like. These pigments and dyes are used alone or in combination.

Suitable polyester resins for use in the toner of the present invention include polyester resins prepared by condensation-polymerizing an alcohol component with a carboxylic acid component.

Specific examples of the alcohol component include diols such as ethylene glycol, diethylene glycol, triethylene glycol, 1,2-propylene glycol, 1,3-propylene glycol, 1,4-butanediol, neopentyl glycol, and 1,4-butenediol; and dihydric alcohol monomers such as 1,4-bis (hydroxymethyl) cyclohexane, bisphenol A, hydrogenated bisphenol A and other dihydric alcohol monomers.

Specific examples of the carboxylic acid components include maleic acid, fumaric acid, mesaconic acid, citraconic acid, itaconic acid, gultaconic acid, phthalic acid, isophthalic acid, terephthalic acid cyclohexanedicarboxylic acid, succinic acid, adipic acid, sebacic acid, malonic acid, and their acid anhydrides and low alkyl esters, dimer of linolenic acid and other dibasic organic acid monomers.

In the polyester resins for use in the present invention, one or more alcohol components and carboxylic acid components (including carboxylic acid anhydrides), which have three or more functional groups, are included as well as the monomers having two functional groups mentioned above.

Specific examples of the carboxylic acid components and their acid anhydrides, which have three or more functional groups, include 1,2,4-benzentricarboxylic acid, 1,2,5-benzenetricarboxylic acid, 1,2,4-cyclohexanetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxyl propane, tetra (methylenecarboxyl)methane, 1,2,7,8-octanetetracarboxylic acid, trimer acids of embole, and their acid anhydrides, and the like.

Specific examples of the alcohol components having three or more functional groups for use in the polyester resins include glycerin, 1,1,1-trimethylol ethane, 1,1,1-trimethylol propane, 1,1,1-trimethylol butane, pentaerythritol, 1,1,2,2-tetramethylol ethane, 1,1,3,3-tetramethylol propane sorbitol, polyvinyl alcohol, and the like.

Suitable materials for use as the release agent in the toner include solid silicone varnishes, higher fatty acids, higher alcohols, montan waxes, oxidized waxes, low molecular weight polyethylene waxes, low molecular weight polypropylene waxes, carnauba wax, paraffin waxes, ester waxes, amide waxes, bisamide waxes, partially-saponified ester waxes, and the like. The concentration of the release agent in the toner is from 1 to 20 parts by weight, and preferably from 3 to 10 parts by weight, per 100 parts by weight of the binder resin included in the toner.

Specific examples of the external additive include silica, alumina, titania, barium titanate, magnesium titanate, calcium titanate, strontium titanate, zinc oxide, cerium oxide, antimony trioxide, zirconium oxide, silicon carbide, silicone nitride, zinc stearate, aluminum stearate, lithium stearate, stearic acid, hardened castor oil and the like. The concentration of the external additive in the toner is from 0.1 to 5 parts by weight, and preferably from 0.3 to 2 parts by weight, per 100 parts by weight of the binder resin included in the toner.

Suitable charge controlling agents include Nigrosine dyes, Nigrosine dyes modified by a fatty acid, metal-containing Nigrosine dyes, metal-containing Nigrosine dyes modified by a fatty acid, chromium complexes of 3,5-ditert-butyl salicylate and the like. The concentration of the charge controlling agent in the toner is from 0 to 20 parts by weight per 100 parts by weight of the toner.

The toner of the present invention is prepared by mixing the above-mentioned one or more binder resins, and colorants and/or magnetic powders, together with one or more charge controlling agents, and other additives, if desired, while one or more components are melted, if necessary.

Next, the methods for measuring the viscoelasticity characteristics will be explained in detail.

(1) a toner plate having a size of 20 mm×20mm and a thickness of 2 mm is prepared by hot pressing;
(2) the toner is set in a DVE rheospectror manufactured by Rheology Co., Ltd. and heated to a predetermined temperature (150° C. in this case);
(3) the toner plate is subjected to sine vibration (frequency: $1\times10^{-2}$–$1\times10^{2}$ rad/sec) in a shearing direction by an non-resonant forced vibration method to measure stress response when ultra-microscopically displaced; and
(4) the storage modulus (G'), loss modulus (G"), and loss tangent (tan δ) are determined by the dynamic stress and strain using known calculation-methods.

In the present invention, the method for determining the molecular weight distribution of a binder resin by a gel permeation chromatography (GPC) method using tetrahydrofuran as a solvent is as follows:

(1) a column is stabilized in a heat chamber of 40° C.;
(2) a solvent, tetrahydrofuran, is flown through the column at a flow rate of 1 ml/min; and
(3) about 100 μl of a tetrahydrofuran solution of a sample to be measured is injected to the column to determine the molecular distribution of the sample.

The same operations are performed with respect to several standard polystyrene resins, which have different molecular weights and each of which have a single molecular weight, to prepare a calibration curve. It is preferable to use at least about ten standard polystyrenes to prepare the calibration curve. For example, polystyrenes having a molecular weight of from $10^2$ to $10^7$ manufactured by Pressure Chemical Co., or Tosoh Corp. are exemplified as the standard polystyrene.

In addition, an RI (refractive index) detector is used as the detector.

With respect to the column, a combination of plural marketed polystyrene gel columns is preferably used. Specific example of the combination of plural polystyrene gel columns include a combination of Shodex GPC KF-801, 802, 803, 804, 805, 806 and 800P or a combination of Shodex GPC KF-801, 802, 803, 804, 805, 806, 807 and 800P manufactured by Showa Denko K.K.; and a combination of Ultrastyradial 500A-THF, $10^3$A-THF, $10^5$A-THF and $10^6$A-THF or a combination of A-Toluene series which are manufactured by Water Corp.

The solution of the sample is prepared as follows;

(1) a sample to be measured is added into tetrahydrofuran and allowed to settle for a few hours;
(2) the mixture is shaken well to perfectly dissolve the sample in tetrahydrofuran;
(3) the solution is then allowed to settle for more than 12 hours, and preferably more than 24 hours; and
(4) the solution is filtrated using a filter having a pore size of from 0.45 to 0.5 μm, such as My-Shori-Disc H-25-5 manufactured by Tosoh Corp. and Skichro-Disc 25 CR manufactured by Space German Science Japan Corp.

Thus, a sample solution can be prepared. The concentration of the sample in the solution is controlled so as to be from 0.5 to 5 mg/ml.

The toner of the present invention is prepared, for example, by the following method;

(1) one or more resins and colorants are mixed, together with one or more charge controlling agents, release agents, and magnetic materials, if desired;
(2) the mixture is heated and kneaded using a kneader such as heat two-roll mills and extruders;
(3) the kneaded mixture is cooled;
(4) the cooled mixture is pulverized with a pulverizer such as jet mills;
(5) the pulverized mixture particles are classified to obtain a mother toner having a desired particle diameter; and
(6) an external additive is added to the mother toner and then mixed in a mixer to prepare a toner.

The toner powder may be formed by milling a mixture of one or more binder resins, colorants and solvents to prepare a toner liquid, and then spraying the toner liquid to dry the solvent.

The toner of the present invention can be used as a one component developer and for two component developers.

When the toner of the present invention is used as a one component developer, a magnetic material such as ferrites, magnetites, alloys and compounds including an element having ferromagnetic property such as iron, cobalt and nickel; alloys, which do not originally have ferromagnetic property but exhibit ferromagnetic property when subjected to a heat treatment, such as Heusler's alloys including manganese and copper (e.g., Mn—Cu—Al, and Mn—Cu—Sn) and chromium dioxide; and the like can be included in the toner. It is preferable that a fine particulate magnetic material having an average particle diameter of from 0.3 to 30 μm is dispersed in a binder resin. The concentration of the magnetic particles in the toner is from 20 to 70% by weight, and preferably from 40 to 70% by weight.

When the toner of the present invention is used for a two component developer, the toner is typically constituted by one or more binder resins, colorants and charge controlling agents.

In order to use the toner of the present invention for cascade developing methods, magnetic developing methods, and O-shell developing methods, the weight average particle diameter of the toner is preferably not greater than about 30 μm, and more preferably from 4 to 20 μm. When the toner is used for powder developing methods, the particle diameter of the toner is preferably slightly smaller than 1 μm.

In the present invention, known carrier materials, which are coated with a resin or are not coated, can be used as a carrier of a two component developer if the carrier materials can impart an opposite charge to the toner of the present invention when the toner particles adhere on the surface of the carrier materials.

The electrophotographic image forming method of the present invention will be explained.

FIG. 1 is a schematic view illustrating an image forming apparatus 100 useful for the image forming method of the present invention.

As shown in FIG. 1, a toner container 1 is horizontally and detachably set in a toner supplying device 10 of the image forming apparatus 100. The toner supplying device 10 includes a toner container supporting member 12 which supports a toner container 1 such that the opening 2 of the toner container leads to a toner supplying portion 16 in a developing device 30 of the image forming apparatus 100. In addition, the toner supplying device 10 includes a toner container rotating member 14 which rotates the toner container 1 such that the container 1 rotates around the center axis thereof. A toner t is discharged from the opening 2 toward the toner supplying portion 16.

As shown in FIG. 1, a layer of a developer including the toner t is formed on a developing roller 32. On the other hand, a photorecepter 20 (i.e., an image bearing member) is charged with a charger 22. Then an imagewise light irradiating device 24 irradiates the charged photoreceptor with light to form an electrostatic latent image on the photorecepter 20. The latent image is developed with the layer to form a toner image on the photoreceptor 20. The toner image is transferred to a receiving paper P using a transfer device 40. Then the photorecepter 20 is cleaned with a cleaner 50. The toner image on the receiving paper P is fixed. Thus, a document is produced.

The developer may be a one component developer or a two component developer.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

At first, the toners prepared below were evaluated by the following methods:

1. Melt index (MI)

The melt index was measured using a flow tester, FLOW RATE COUNTER TYPE C-5059D manufactured by TOYO SEIKI Co., Ltd. The tester was warmed up so that the temperature of the sample holder was 150° C. When the temperature was stabilized at 150° C., 5 g of a toner was contained in the holder. The total quantity (g) of the flowed toner for 10 minutes, which is the melt index, was determined while a pressure of 2160 g was applied to the toner.

2. Fixing property

The fixing property was evaluated using a heat roller fixing device. The temperature of the heat roller was changed from 135 to 170° C. at an interval of 5° C. A toner image whose image density was 1.2 was prepared and fixed with the fixing device. The fixed toner image was rubbed ten times with a sand-containing eraser provided on a clock meter. The fixing property is classified as follows:

○○○: Excellent
○○: Excellent–Good
○: Good
Δ: Slightly poor
×: Poor

3. Offset resistance

The hot offset resistance was evaluated using the heat roller device used for evaluating the fixing property. The temperature of the heat roller was changed from 160 to 240° C. at an interval of 5° C. A toner image was fixed by the heat roller device. Then a white paper was passed through the fixing device. The white paper was visually observed to determine whether the white paper was dirtied with the toner (i.e., whether a hot offset phenomenon occurred). The offset resistance is also classified as follows:

○○○. Excellent
○; Excellent–Good
○: Good
Δ: Slightly poor
×: Poor

4. Image qualities

Thirty (30) grams of a toner, whose average particle diameter was 8.5 μm, were mixed with 970 g of an iron carrier. Thus, a two component developer was prepared. The developer was contained in the developing unit of a copier (Spirio 7000, manufactured by RicohCo., Ltd.), and images were produced. The images were visually observed whether there were a black streak and/or background fouling in the image. The image qualities (black streak and background fouling) are classified as follows:

○○○. Excellent
○○: Excellent–Good
○: Good
Δ: Slightly poor
×: Poor

5. Pulverizability

A mother toner was manufactured by kneading toner materials while heating, crushing the kneaded material with a hammer mill after cooling, and then pulverizing the crushed mixture with a jet air mill to prepare mother toner particles having an average particle diameter of from 8 to 9 μm. The feeding quantity of the crushed mother toner particles in the jet air mill was examined as an index of pulverizability. At this point, the air pressure in the jet air mill was 5.0 kg/cm$^2$. The pulverizability of the toners is also classified as follows:

○○○: Excellent
○○: Excellent–Good
○: Good
Δ: Slightly poor
×: Poor

The method for extracting components having a molecular weight of from 100,000 to 10,000,000 from a polymer is as follows:

(1) Apparatus

LC-908 (manufactured by Nippon Bunseki Kogyo K.K.)
JRS-86 (repeat injector, manufactured by Nippon Bunseki Kogyo K.K.)
JAR-2 (automatic sampler, manufactured by Nippon Bunseki Kogyo K.K.)

FC-201 (fraction collector, manufactured by Gilson Corp.)

(1) Column

JAIGEL-1H–5H (diameter and length of the column are 20 mm and 600 mm, respectively)

(2) Measuring conditions

Tempersture: 40° C.

Solvent: tetrahydrofuran

Quantity of flow: 5 ml/main

Detector: RI (refractive index) detector

At first, the time at which components having a molecular weight of from 100,000 to 10,000,000 (sutb-peak components) were eluted was preliminarily measured. Then the extraction operation was performed to obtain the components having a molecular weight of from 100,000 to 10,000,000. The viscoelasticity characteristics of the thus obtained sub-peak resin components were measured.

In addition, the concentration of the sub-peak components was determined by weighing the extracted sub-peak components and the extracted components having a molecular weight less than 100,000.

Then the synthesizing method of resins used as binder resins in the following examples will be explained.

Synthesis of Polyester Resin A-1

The following components were contained in a four-neck flask of 3 liter on which a thermometer, a stainless stirrer, a condenser, and a nitrogen-introducing tube were provided.

| | |
|---|---|
| Polyoxypropylene(2,2)-2,2-bis(4-hydroxyphenyl)propane | 400 g |
| Polyoxyethylene (2)-2,2-bis(4-hydroxyphenyl)propane | 350 g |
| Ethylene glycol | 200 g |
| Terephthalic acid | 600 g |
| Benzene tricarboxylic acid | 180 g |
| Dibutyl tin oxide | 2.5 g |

The flask was heated with a mantle heater such that the temperature of the mixture was 190° C. The mixture was heated at 190° C. for 6 hours under a nitrogen environment to perform condensation polymerization. After the 6-hour reaction, the torque needed for stirring the reaction product was 3.5 kg.cm. Then the reaction product was cooled to stop the polymerization.

Synthesis of Polyester Resin A-2

The procedure for preparation of the polyester resin A-1 was repeated except that the formulation of the polyester resin was changed as follows:

| | |
|---|---|
| Polyoxypropylene(2,2)-2,2-bis(4-hydroxyphenyl)propane | 20 g |
| Polyoxyethylene(2)-2,2-bis(4-hydroxyphenyl)propane | 7 g |
| Ethylene glycol | 13 g |
| Terephthalic acid | 45 g |
| Trimellitic acid anhydride | 15 g |

When the reaction was stopped, the torque for stirring the reaction product was 5.5 kg.cm.

Synthesis of Polyester Resin A-3

The procedure for preparation of the polyester resin A-1 was repeated except that the formulation of the polyester resin was changed as follows:

| | |
|---|---|
| Polyoxypropylene(2,2)-2,2-bis(4-hydroxyphenyl)propane | 15 g |
| Polyoxyethylene(2)-2,2-bis(4-hydroxyphenyl)propane | 20 g |
| Propylene glycol | 5 g |
| Terephthalic acid | 40 g |
| Trimellitic acid anhydride | 20 g |

When the reaction was stopped, the torque for stirring the reaction product was 4.0 kg.cm.

Then the method for preparing vinyl polymers will be explained.

Synthesis of Vinyl Polymer S-4

The following components were contained in a four-neck flask of 3 liter on which a thermometer, a stainless stirrer, a condenser, and a nitrogen-introducing tube were provided.

| | |
|---|---|
| Styrene monomer | 500 g |
| n-butyl methacrylate monomer | 200 g |
| Divinyl benzene | 5.0 g |
| Benzoyl peroxide (BPO) | 20 g |
| Deionized water | 1500 g |
| Sodium salt of dodecyl benzene sulfonic acid | 10 g |

The flask was heated with a mantle heater such that the temperature of the mixture was 90° C. The mixture was heated at 90° C. for 12 hours under a nitrogen environment to perform polymerization. Then the reaction product was cooled to stop the polymerization. The polymer was washed with water and then dried under a pressure of 10 torr. Thus a powder which included a volatile matter not greater than 1% was prepared.

Synthesis of Vinyl Polymer S-5

The procedure for preparation of the polymer S-4 was repeated except that the formulation of the polymer was changed as follows:

| | |
|---|---|
| Styrene monomer | 500 g |
| n-butyl methacrylate monomer | 200 g |
| Divinyl benzene | 7.0 g |
| Benzoyl peroxide (BPO) | 20 g |
| Deionized water | 1500 g |
| Sodium salt of dodecyl benzene sulfonic acid | 10 g |

Synthesis of Vinyl Polymer S-6

The procedure for preparation of the polymer S-4 was repeated except that the formulation of the polymer was changed as follows:

| | |
|---|---|
| Styrene monomer | 500 g |
| n-butyl methacrylate monomer | 200 g |
| Divinyl benzene | 15 g |

-continued

| | |
|---|---|
| Benzoyl peroxide (BPO) | 20 g |
| Deionized water | 1500 g |
| Sodium salt of dodecyl benzene sulfonic acid | 10 g |

Example 1

The following components were mixed using a Renshel mixer, and then kneaded for 20 minutes at 130° C. using a two-roll mill.

| | |
|---|---|
| Styrene-acrylic resin S-4 prepared above (binder resin) | 100 |
| Carbon black (colorant) (manufactured by Mitsubishi Chemical Corp.) | 15 |
| Candelilla Wax 102 (release agent) (manufactured by Ceralica Noda) | 5 |
| P-51 (charge controlling agent) (manufactured by Orient Chemical Industries Co., Ltd.) | 1 |

Then the kneaded mixture was cooled, and crushed with a cutter mill. The crushed mixture was pulverized using a jet mill, and then classified using an air classifier. Thus mother toner particles having an average particle diameter of 8.5 $\mu$m was prepared.

One half part by weight of hydrophobic colloidal silica was added to 100 parts by weight of the mother particles, and the mixture was mixed using a Henshel mixer. Thus a toner of the present invention was prepared.

Examples 2–6

The procedure for preparation of the toner in Example 1 was repeated except that the formulation of the binder resin and the kneading conditions were changed as shown in Table 1. Thus toners of the present invention were prepared.

TABLE 1

| | Example | | | | | |
|---|---|---|---|---|---|---|
| | 1 | 2 | 3 | 4 | 5 | 6 |
| Binder resin | | | | | | |
| Styrene-acrylic resin | S-4 | S-5 | S-6 | S-5 | S-4 | S-6 |
| Addition amount of styrene-acrylic resin | 100 | 50 | 20 | 100 | 30 | 40 |
| Polyester resin | — | A-1 | A-2 | — | A-3 | A-2 |
| Addition amount of polyester resin | 0 | 50 | 80 | 0 | 70 | 60 |
| Kneading condition | | | | | | |
| Kneading temp. (° C.) | 130 | 130 | 130 | 130 | 150 | 150 |
| Kneading time (minute) | 20 | 20 | 30 | 30 | 20 | 30 |

Comparative Examples 1–5

The procedure for preparation of the toner in Example 1 was repeated except that the formulation of the binder resin and the kneading conditions were changed as shown in Table 2. Thus comparative toners were prepared.

TABLE 2

| | Comparative Example | | | | |
|---|---|---|---|---|---|
| | 1 | 2 | 3 | 4 | 5 |
| Binder resin | | | | | |
| Styrene-acrylic resin | S-6 | S-4 | S-4 | S-5 | S-5 |
| Addition amount of styrene-acrylic resin | 100 | 20 | 100 | 50 | 30 |
| Polyester resin | — | A-1 | — | A-2 | A-3 |
| Addition amount of polyester resin | 0 | 80 | 0 | 50 | 70 |
| Kneading condition | | | | | |
| Kneading temp. (° C.) | 170 | 150 | 130 | 170 | 170 |
| Kneading time (minute) | 20 | 10 | 40 | 20 | 20 |

The physical properties and image qualities of the thus prepared toners are shown in Tables 3 and 4.

TABLE 3

| | Comparative Example | | | | | |
|---|---|---|---|---|---|---|
| | 1 | 2 | 3 | 4 | 5 | 6 |
| Toner properties | | | | | | |
| M.W of main-peak components | 6200 | 7800 | 3500 | 5100 | 9000 | 2800 |
| Conc. of sub-peak components (% by weight) | 22 | 16 | 30 | 10 | 30 | 25 |
| G' (dyne/Cm$^2$) | $\frac{2\times10^5}{4\times10^7}$ | $\frac{1\times10^5}{9\times10^6}$ | $\frac{4\times10^5}{3\times10^7}$ | $\frac{3\times10^5}{5\times10^7}$ | $\frac{1\times10^6}{4\times10^7}$ | $\frac{2\times10^5}{4\times10^7}$ |
| Conc. of components having M.W. less than 1000 (% by weight) | 5 | 2 | 0 | 0 | 0 | 0 |
| MI (g/10 min) | 32 | 4 | 18 | 25 | 5 | 30 |
| Pulverizability | ○ | ○ | ○○ | ○○ | ○○ | ○○ |
| Conc. of material insoluble in THF (% by weight) | 0 | 0 | 0 | 0 | 0 | 0 |
| Image qualities | | | | | | |
| Fixability | ○ | ○○ | ○○○ | ○○ | ○○○ | ○○○ |
| Hot-offset resist. | ○ | ○ | ○ | ○ | ○ | ○ |
| Background fouling | ○ | ○ | ○ | ○ | ○ | ○ |
| Black streak | ○ | ○ | ○ | ○ | ○ | ○ |

○○○: Excellent
○○: Excellent–Good
○: Good
Δ: Slightly poor
x: Poor

TABLE 4

| | Comparative Example | | | | |
|---|---|---|---|---|---|
| | 1 | 2 | 3 | 4 | 5 |
| Toner properties | | | | | |
| M.W of main-peak components | 13000 | 4200 | 8100 | 5000 | 3800 |
| Conc. of sub-peak components (% by weight) | 18 | 42 | 27 | 12 | 5 |
| G' (dyne/Cm$^2$) | $\frac{5 \times 10^5}{2 \times 10^7}$ | $\frac{6 \times 10^5}{5 \times 10^7}$ | $\frac{9 \times 10^4}{1 \times 10^7}$ | $\frac{3 \times 10^5}{7 \times 10^7}$ | $\frac{2 \times 10^6}{3 \times 10^7}$ |
| Conc. of components having M.W. less than 1000 (% by weight) | 0 | 0 | 0 | 0 | 0 |
| MI (g/10 min) | 12 | 23 | 7 | 20 | 15 |
| Pulverizability | x | Δ | ○○ | Δ | ○ |
| Conc. of material insoluble in THF (% by weight) | 0 | 0 | 0 | 0 | 5 |
| Image qualities | | | | | |
| Fixability | x | x | ○ | x | Δ |
| Hot-offset resist. | ○ | ○ | Δ | ○ | x |
| Background fouling | ○ | ○ | x | ○ | Δ |
| Black streak | ○ | ○ | x | ○ | Δ |

○○○: Excellent
○○: Excellent–Good
○: Good
Δ: Slightly poor
x: Poor

As mentioned above, the toner of the present invention can produce good images without causing image defects such as background fouling and black streak. In addition, the produced images have good fixing property and good hot-offset resistance. Further, since the pulverizability of the toner is good, the toner can be easily manufactured.

This document claims priority and contains subject matter related to Japanese Patent Application No. 11-149674, filed on May 28, 1999, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An electrophotographic toner comprising a binder resin, a colorant, and an external additive, wherein the binder resin is soluble in tetrahydrofuran and comprises at least a first resin component and a second resin component, wherein the first resin component has a molecular weight distribution such that a peak is present in a molecular weight range of from 1,000 to 10,000, and the second resin component has a molecular weight distribution such that a peak is present in a molecular weight range of from 100,000 to 10,000,000, wherein the peak of the first resin component is the largest, and the second resin component is present in the binder resin in an amount of from 10 to 30% by weight, and wherein the second resin component has a dynamic modulus G' of from 100,000 to 50,000,000 dyne/cm$^2$ when the dynamic modulus is measured by a frequency sweep method under conditions of 150° C. in temperature and 0.01 to 100 rad/sec in frequency, and wherein the binder resin comprises one or more polyester resins in an amount of from 50 to 80% by weight of the binder resin and one or more styrene-acrylic resins in an amount of from 20 to 50% by weight of the binder resin.

2. The electrophotographic toner according to claim 1, wherein the binder resin does not include a resin component having a molecular weight less than 1000.

3. The electrophotographic toner according to claim 1, wherein the toner has a melt index of from 5 to 30 g/10 min.

4. The electrophotographic toner according to claim 1, wherein the toner further comprises a magnetic material.

5. An electrophotographic image forming method comprising:

forming an electrostatic latent image on an image bearing member; and developing the electrostatic latent image with a developer including a toner to form a toner image on the image bearing member, wherein the toner comprises a binder resin, a colorant, and an external additive, wherein the binder resin is soluble in tetrahydrofuran and comprises at least a first resin component and a second resin component, wherein the first resin component has a molecular weight distribution such that a peak is present in a molecular weight range of from 1,000 to 10,000, and the second resin component has a molecular weight distribution such that a peak is present in a molecular weight range of from 100,000 to 10,000,000, wherein the peak of the first resin component is the largest, and the second resin component is present in the binder resin in an amount of from 10 to 30% by weight, and wherein the second resin component has a dynamic modulus G' of from 100,000 to 50,000,000 dyne/cm$^2$ when the dynamic modulus is measured by a frequency sweep method under conditions of 150° C. in temperature and 0.01 to 100 rad/sec in frequency, and wherein the binder resin of the toner comprises one or more polyester resins in an amount of from 50 to 80% by weight of the binder resin and one or more styrene-acrylic resins in an amount of from 20 to 50% by weight of the binder resin.

6. The electrophotographic image forming method according to claim 5, wherein the binder resin of the toner does not include a resin component having a molecular weight less than 1000.

7. The electrophotographic image forming method according to claim 5, wherein the toner has a melt index of from 5 to 30 g/10 min.

8. The electrophotographic image forming method according to claim 5, wherein the toner further comprises a magnetic material.

* * * * *

UNITED STATES PATENT AND TRADEMARK OFFICE

CERTIFICATE OF CORRECTION

PATENT NO. : 6,303,257 B1
DATED : October 16, 2001
INVENTOR(S) : Kumi Hasegawa et al.

It is certified that error appears in the above-identified patent and that said Letters Patent is hereby corrected as shown below:

Column 4,
Line 42, “used” should read -- used, --.

Column 10,
Line 29, “skichro” should read -- Ekichro --.

Column 15,
Line 10, “Renshel” should read -- Henshel --.
Line 30, “Iienshel” should read -- Henshel --.

Signed and Sealed this

Fourth Day of June, 2002

*Attest:*

*Attesting Officer*

JAMES E. ROGAN
*Director of the United States Patent and Trademark Office*